US006266975B1

(12) United States Patent
Assaf

(10) Patent No.: US 6,266,975 B1
(45) Date of Patent: Jul. 31, 2001

(54) HEAT PUMP/ENGINE SYSTEM AND A METHOD FOR UTILIZING SAME

(75) Inventor: Gad Assaf, Beer Sheva (IL)

(73) Assignee: Agam Energy Systems Ltd., Hod Hasharon (IL)

( * ) Notice: Subject to any disclaimer, the term of this patent is extended or adjusted under 35 U.S.C. 154(b) by 0 days.

(21) Appl. No.: 09/529,109

(22) PCT Filed: Oct. 26, 1998

(86) PCT No.: PCT/IL98/00520

§ 371 Date: Jun. 19, 2000

§ 102(e) Date: Jun. 19, 2000

(87) PCT Pub. No.: WO99/22180

PCT Pub. Date: May 6, 1999

(30) Foreign Application Priority Data

Oct. 29, 1997 (IL) ..... 122065

(51) Int. Cl.[7] ..... F25B 15/00

(52) U.S. Cl. ..... 62/476; 62/335; 62/310; 62/314; 62/306; 62/271

(58) Field of Search ..... 62/335, 306, 310, 62/314, 271, 476

(56) References Cited

U.S. PATENT DOCUMENTS

| | | | | |
|---|---|---|---|---|
| 2,672,024 | * | 3/1954 | McGrath | 62/6 |
| 3,018,231 | * | 1/1962 | Valentine et al. | 202/158 |
| 3,415,502 | * | 12/1968 | Munters | 261/112 |
| 4,212,714 | * | 7/1980 | Coker et al. | 204/98 |
| 5,729,993 | * | 3/1998 | Boiarski et al. | 62/175 |
| 6,122,930 | * | 9/2000 | Nishiguchi et al. | 62/476 |
| 6,148,634 | * | 11/2000 | Sherwood | 62/434 |

* cited by examiner

*Primary Examiner*—William Doerrler
*Assistant Examiner*—Mark S. Shulman
(74) *Attorney, Agent, or Firm*—Bachman & LaPointe, P.C.

(57) ABSTRACT

The invention provides a heat pump/engine system having a water/brine flash evaporator in fluid communication with a first air/brine heat exchanger, a brine condenser in fluid communication with a second air/brine heat exchanger, and a vapor compressor/turbine connected on a fluid conduit leading from the flash evaporator to the brine condenser. Heat/pump methods are also provided herein.

15 Claims, 3 Drawing Sheets

HEAT PUMP/ENGINE SYSTEM AND A METHOD FOR UTILIZING SAME

FIELD OF THE INVENTION

The present invention relates to a heat pump/engine system and method, in particular to a heat pump/engine system and method for the air-conditioning of enclosed spaces.

BACKGROUND OF THE INVENTION

Conventional air-conditioners are effective in removing Sensible Heat (SH) and less effective in removing Latent Heat (LH). To remove heat, the evaporator of the air-conditioner must be cold compared with the ambient air which is normally about 26° C. Yet to remove vapor, the evaporator should be cold compared with the dew point temperature, which is about 15° C.

It can be shown that when the LH exceeds the SH, the humidity in a conventionally conditioned enclosed space exceeds 60%, which humidity is the maximum humidity recommended for maintaining a comfortable environment. For this reason, in humid climate air-conditioning systems require an absorption machine which, while removing humidity, heats the enclosed space, and thus, reduces the efficiency of the conditioning system.

In PCT Application Publication No. WO96/33378, there is disclosed a heat pump system and method for air-conditioning utilizing a refrigerant evaporation and a refrigerant condenser for exchanging heat with brine solution. The refrigerant is considered to have an adverse effect on the ozone, and thus, it is recommended to avoid the use thereof.

SUMMARY OF THE INVENTION

Hence, it is a general object of the present invention to provide an environmental friendly heat pump/engine system and method utilizing a water/brine flash evaporator and air/brine heat exchangers.

It is a further object of the present invention to provide a heat pump/engine system and a method for air-conditioning an enclosed space by controlling the heat load in the enclosed space, by regulating the water/brine concentration of a flash evaporator.

It is still a further object of the present invention to provide a heat pump/engine method and a system for air-conditioning an enclosed space by controlling the temperature of the water and or the brine of said flash evaporator.

According to the present invention there is therefore provided a heat pump/engine system, comprising a water/brine flash evaporator in fluid communication with a first air/brine heat exchanger, a brine condenser in fluid communication with a second air/brine heat exchanger, and a vapor compressor/turbine connected on a fluid conduit leading from said flash evaporator to said brine condenser.

The invention further provides a heat pump/engine method, comprising a flash water/brine evaporator in fluid communication with a first air/brine heat exchanger, a brine condenser in fluid communication with a second air/brine heat exchanger, and a vapor compressor/turbine connected on a fluid conduit leading from said flash evaporator to said brine condenser, and regulating the heat load in an enclosed space by controlling the water flow in said flash evaporator in accordance with humidity and heat load in said space.

The invention will now be described in connection with certain preferred embodiments with reference to the following illustrative figures, so that it may be more fully understood.

With specific reference now to the figures in detail, it is stressed that the particulars shown are by way of example and for the purposes of illustrative discussion of the preferred embodiments of the present invention only and are presented in the cause of providing what is s believed to be the most useful and readily understood description of the principles and conceptual aspects of the invention. In this regard, no attempt is made to shown structural details of the invention in more detail that is necessary for a fundamental understanding of the invention, the description taken with the drawings making apparent to those skilled in the art how the several forms of the invention may be embodied in practice.

DETAILED DESCRIPTION OF THE PREFERRED EMBODIMENTS

Figure 1:
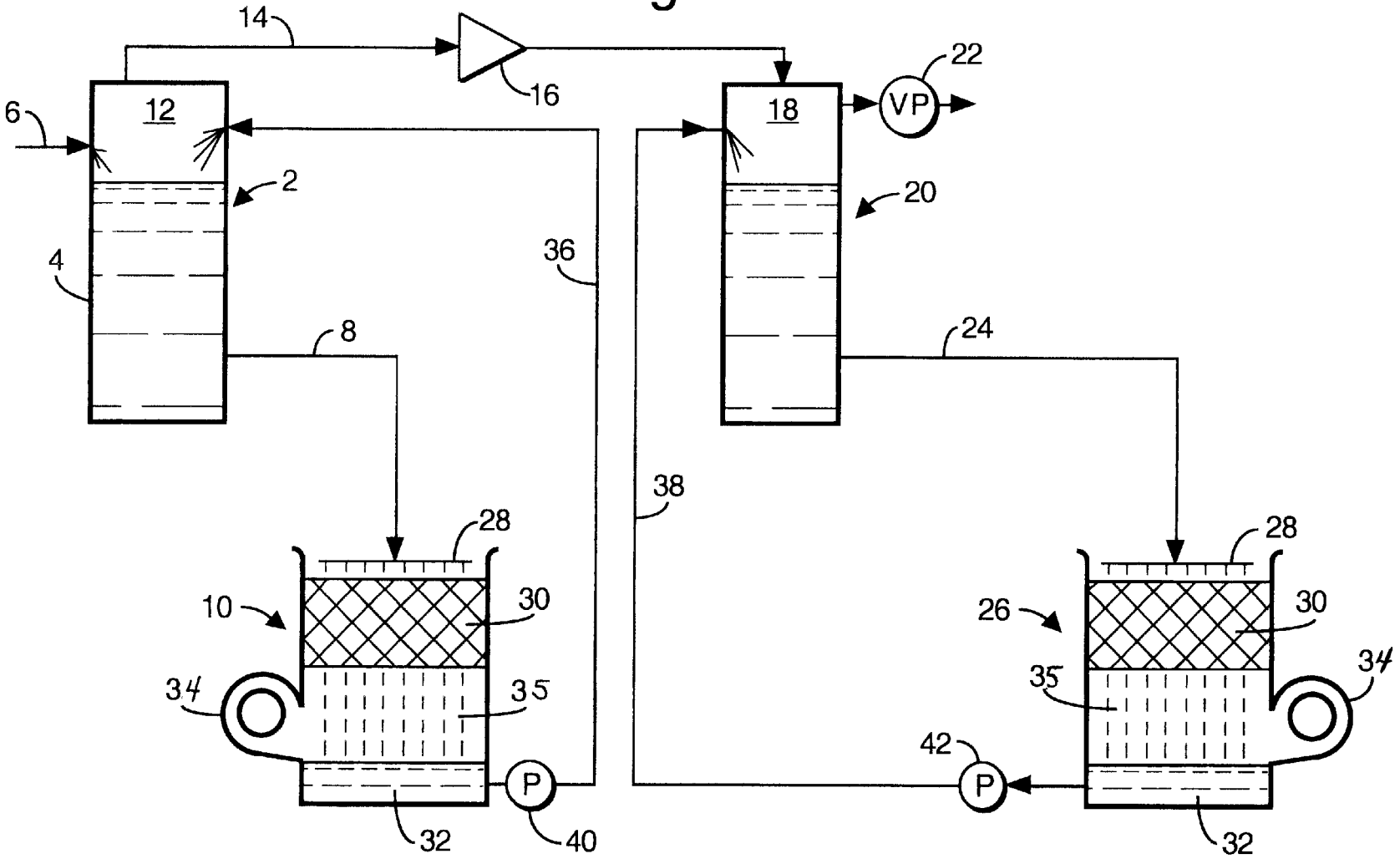
FIG. 1 is a schematic illustration of a heat pump/engine system according to the present invention.

Referring to FIG. 1 there is seen a heat pump/engine system, including a water/brine flash evaporator 2 having a housing 4, a water inlet 6 and a brine outlet conduit 8 leading from the bottom portion of the housing to a drip-type air-brine heat exchanger 10. The top portion of the housing 4 constituting a vapor chamber 12 communicating with via conduit 14 and vapor compressor 16 with a vapor chamber 18 of a brine condenser 20. To the vapor chamber 18 there is attached a vacuum pump 22. The output from brine condensor 20 leads via conduit 24 to a second, air/brine heat exchanger 26. Both heat exchangers 10 and 26 are similarly structured and are advantageously composed of an inlet 28 in the form of drip or spray nozzles, a brine/air heat exchanging means 30, e.g., densely folded carton paper or packed particles. The lower portion of the heat exchangers constitute a brine reservoir 32. For a more effective operation, there is installed an air blower 34 for introducing forced ambient air in the drip portion 35.

The cold brine accumulated at the reservoirs 32 are recycled back to the brine flash evaporator 2 and to the condensor 20, via conduits 36,38, respectively, by means of pumps 40,42.

In dry climate areas, the environmental vapor pressure may be lower than the vapor pressure inside the air-conditioned enclosed space. In such a case, the compressor 16 becomes a turbine, i.e., supplies, instead of consumes, energy.

In humid areas where the LH is dominant, ventilation will merely introduce more vapor into the enclosed space. When, however, the water is used to further cool down the brine at the flash evaporator 2 and heat exchanger 10, dehumidifying and cooling of air at the air/brine heat exchangers 26, is achieved.

In the event that most of the heat load is SH, the brine will reach a point where it will no longer absorb water vapor. Since the compressor 16 continues to suck vapor from the vapor chamber 12, for the purpose of cooling, fresh water should be supplied through water inlet 6.

Figure 2:
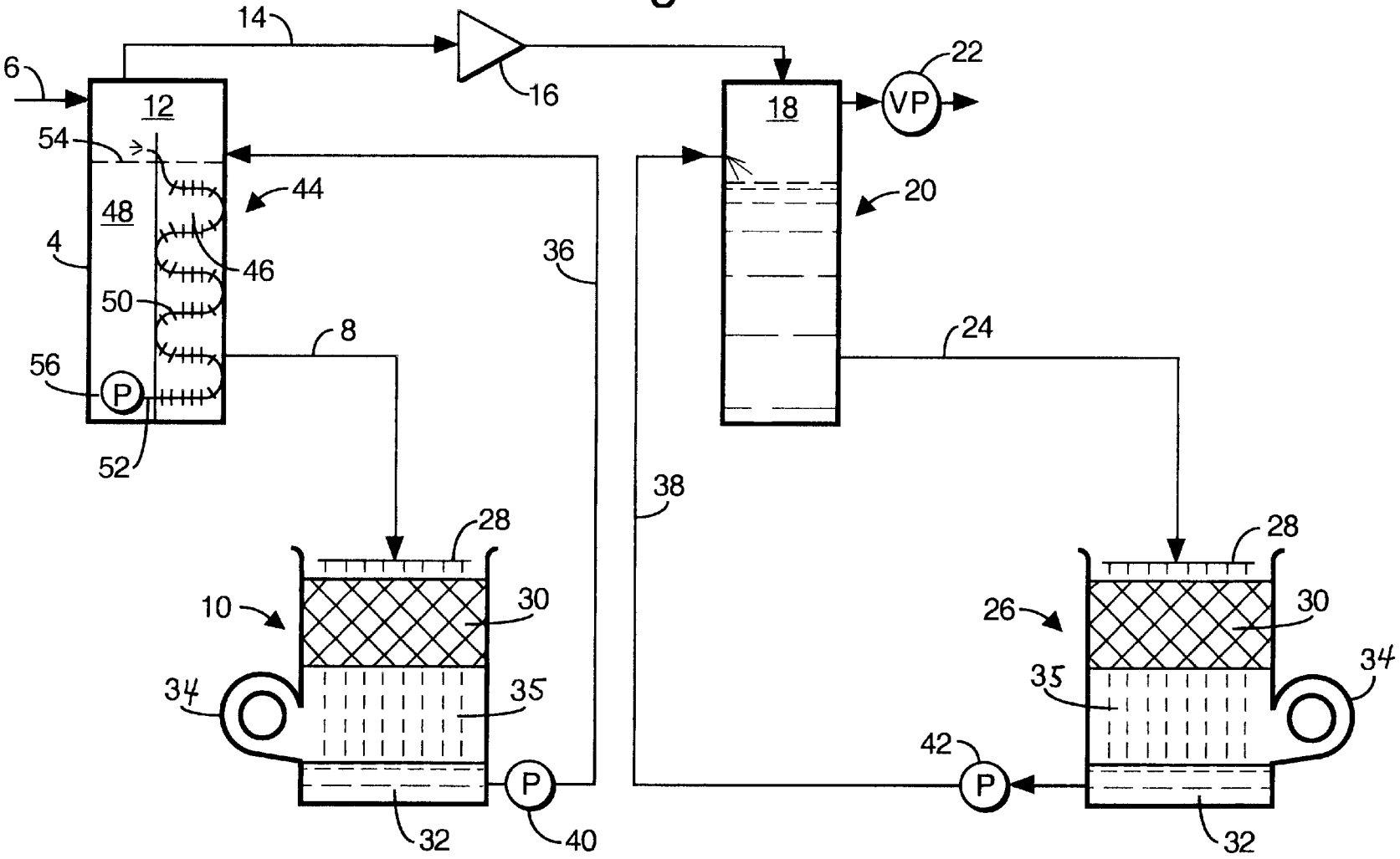
FIG. 2 is a schematic illustration of a further embodiment of a heat pump/engine system.

Referring to FIG. 2, there is illustrated a further embodiment in which there is provided a flash evaporator 44 having two chambers, a brine flash chamber 46 and a water flash chamber 48. A water conduit 50 having an inlet port 52 located adjacent to the bottom of the chamber 48 leads into the brine flash chamber 46, meanders therealong, and exits adjacent to the water level 54 in the water chamber 48. A pump 56 effects the circulation of water through the conduit 50. Instead of the illustrated conduit 50, other types of heat exchangers could just as well be used.

Such a two-chamber flash evaporator has a thermodynamic advantage, in that the brine/water solution is only partly cooled by water, having a vapor pressure which is high relative to the solution and therefore the compressor 16 invests relatively less energy in compressing the vapor.

Otherwise, the system operates similarly to the system of FIG. 1.

Figure 3:
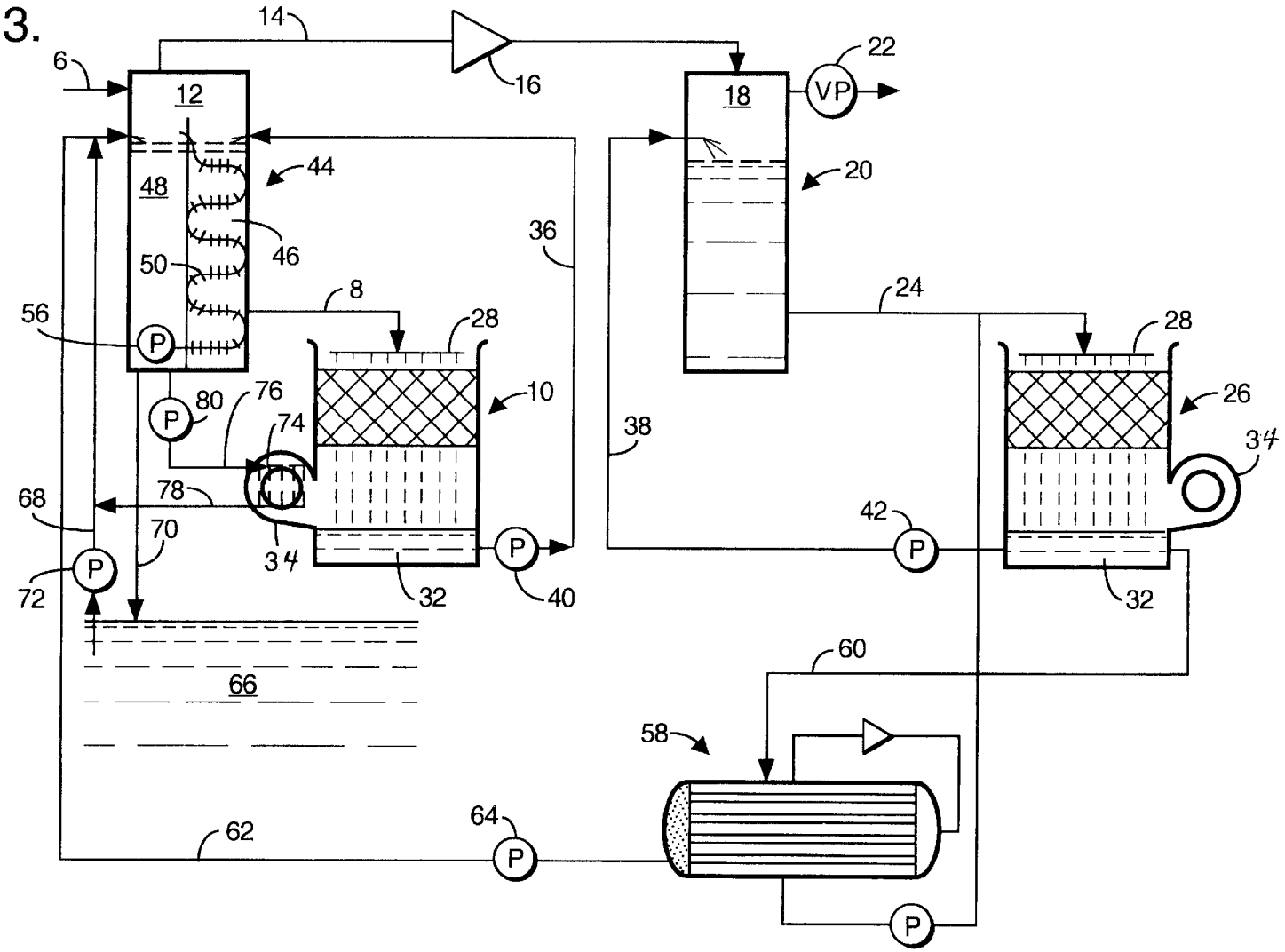
FIG. 3 is a schematic illustration of still a further embodiment of a heat pump/engine system, according to the present invention.

In order to avoid excessive dilution of the brine and to improve performance, a per-se known brine concentrator 58 can be added to the system shown in FIG. 3.

The brine concentrator 58 communicates via conduit 60 with the reservoir 32 of the heat exchanger 26 to receive the diluted brine accumulated therein. The water extracted by the concentrator 58 is driven into the water flash chamber 48 of the water/brine heat exchanger 44 via conduit 62 and pump 64.

In cold climate areas, the system according to the present invention can be used for space heating by providing a heat source. Accordingly, as further seen in FIG. 3, the water in the water flash chamber 48 of flash evaporator 44 originates from a heated source 66, e.g., a water aquifer, and is circulated between the heated source 66 and the chamber 48 via conduits 68 and 70, by means of a pump 72.

Alternatively, or in addition, the brine in heat exchanger 10 absorbs heat and vapor from outside air and part of this heat is used for flushing the brine and part is transmitted via conduit 50 to the water where it is used for water evaporation. There may also be provided a further heat exchanger 74, abutting the blower 34 for cooling the air by means of this heat exchanger, communicating via conduits 76, 78 and circulating pump 80 with the water chamber 48.

It will be evident to those skilled in the art that the invention is not limited to the details of the foregoing illustrated embodiments and that the present invention may be embodied in other specific forms without departing from the spirit or essential attributes thereof the present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A heat pump/engine system, comprising:

a water/brine flash evaporator in fluid communication with a first air/brine heat exchanger;

a brine condenser in fluid communication with a second air/brine heat exchanger, and a vapor compressor/turbine connected on a fluid conduit leading from said flash evaporator to said brine condenser.

2. The system as claimed in claim 1, further comprising a vapor vacuum pump communicating with said brine condenser.

3. The system as claimed in claim 1, further comprising a water source for adding water to said water/brine flash evaporator.

4. The system as claimed in claim 1, wherein said flash evaporator includes a water flash chamber, a brine flash chamber, and heat exchanging means having an inlet and outlet located in said water chamber and at least partly located in said brine flash chamber.

5. The system as claimed in claim 4, wherein said flash evaporator further comprises a water pump for circulating the water in said heat exchanging means.

6. The system as claimed in claim 1, wherein each of said first and second heat exchangers include an air blower for introducing forced air into said heat exchangers.

7. The system as claimed in claim 1, further including a first pump located in the conduit circulating brine from said first air/brine heat exchanger to said flash evaporator.

8. The system as claimed in claim 1, further including a second pump located in the conduit circulating brine from said second air/brine heat exchanger to said brine condenser.

9. The system as claimed in claim 1, wherein at least one of said first and second heat exchangers are direct-contact air/brine heat exchangers.

10. The system as claimed in claim 1, further comprising a brine concentrator operationally interconnected with said flash evaporator and second air/brine heat exchangers.

11. The system as claimed in claim 1, further comprising means for circulating warm water into said flash evaporator.

12. The system as claimed in claim 11, further comprising an air/water heat exchanger associated with said warm water circulating means and said first air/brine heat exchanger.

13. A heat pump/engine method, comprising:

providing a water/brine flash evaporator in fluid communication with a first air/brine heat exchanger, a brine condenser in fluid communication with a second air/brine heat exchanger, and a vapor compressor/turbine connected on a fluid conduit leading from said flash evaporator to said brine condensor, and regulating the heat load in an enclosed space by controlling the water flow in said flash evaporator in accordance with humidity and heat load in said space.

14. A heat pump/engine method, comprising:

a water/brine evaporator in fluid communication with a first air/brine heat exchanger, a brine condenser in fluid communication with a second air/brine heat exchanger, and a vapor compressor/turbine connected on a fluid conduit leading from said flash evaporator to said brine condensor, and regulating the heat load in an enclosed space by controlling the temperature of the brine in said evaporator.

15. A heat pump/engine method, comprising:

providing a water/brine flash evaporator in fluid communication with a first air/brine heat exchanger, a brine condenser in fluid communication with a second air/brine heat exchanger, and a vapor compressor/turbine connected on a fluid conduit leading from said flash evaporator to said brine condensor, and regulating the brine dilution in said evaporator.

* * * * *